US008844475B2

(12) United States Patent
Mukouhara et al.

(10) Patent No.: US 8,844,475 B2
(45) Date of Patent: Sep. 30, 2014

(54) WATER-COOLED V-TYPE ENGINE, AND MOTORCYCLE INCLUDING SAME

(75) Inventors: Hodaka Mukouhara, Saitama (JP); Hiroyuki Sugiura, Saitama (JP); Yohei Makuta, Saitama (JP)

(73) Assignee: Honda Motor Corporation, Tokyo (JP)

( * ) Notice: Subject to any disclaimer, the term of this patent is extended or adjusted under 35 U.S.C. 154(b) by 254 days.

(21) Appl. No.: 13/432,054

(22) Filed: Mar. 28, 2012

(65) Prior Publication Data

US 2012/0247410 A1 Oct. 4, 2012

(30) Foreign Application Priority Data

Mar. 31, 2011 (JP) ..... 2011-080605
Dec. 19, 2011 (JP) ..... 2011-277313

(51) Int. Cl.

| | |
|---|---|
| ***F01P 11/20*** | (2006.01) |
| ***F01P 11/04*** | (2006.01) |
| ***F02B 75/22*** | (2006.01) |
| ***F01P 5/10*** | (2006.01) |
| *F01P 3/02* | (2006.01) |

(52) U.S. Cl.

CPC ..... *F02B 75/22* (2013.01); *F01P 11/04* (2013.01); *F01P 2003/024* (2013.01); *F01P 5/10* (2013.01)

USPC ..... 123/41.47; 123/41.44; 123/41.82 R

(58) Field of Classification Search

CPC .... F02B 75/22; F02B 2075/1808; F01P 3/02; F01P 11/04; F01P 5/10; F01P 2003/027; F01P 2003/028; F01P 2003/024; F01P 2003/021; F01P 2001/023; F01P 7/14

USPC ..... 123/41.47, 41.44, 41.17, 41.72, 41.82 R, 123/41.01

See application file for complete search history.

(56) References Cited

U.S. PATENT DOCUMENTS

| | | | | |
|---|---|---|---|---|
| 4,745,885 | A * | 5/1988 | Koinuma | 123/41.05 |
| 5,111,774 | A * | 5/1992 | Hiramoto et al. | 123/41.1 |
| 5,216,986 | A * | 6/1993 | Ohsawa et al. | 123/184.33 |
| 6,422,182 | B1 * | 7/2002 | Ohta | 123/41.29 |
| 6,505,581 | B2 * | 1/2003 | Niizuma et al. | 123/41.82 R |
| 6,523,506 | B2 * | 2/2003 | Hirano et al. | 123/41.1 |
| 6,814,477 | B2 * | 11/2004 | Yamaguchi et al. | 362/497 |
| 7,367,293 | B2 * | 5/2008 | Takeuchi | 123/41.57 |

(Continued)

FOREIGN PATENT DOCUMENTS

| | | |
|---|---|---|
| JP | 2000-087758 A | 3/2000 |
| JP | 2003-090264 A | 3/2003 |

*Primary Examiner* — Noah Kamen
*Assistant Examiner* — Long T Tran
(74) *Attorney, Agent, or Firm* — Carrier Blackman & Associates, P.C.; Joseph P. Carrier; Anne G. Sabourin

(57) ABSTRACT

A water-cooled V-type engine includes a first coolant passage for supplying a liquid coolant discharged from a water pump disposed proximate a first cylinder, to a water jacket of the first cylinder. The engine also includes a second coolant passage which is branched off from the first coolant passage, and which is provided for supplying coolant to a water jacket of a second cylinder. The engine design allows for a shortened coolant hose. The water pump may include an integral fluid conduit including a branching portion where said second coolant supply passage is branched from said first coolant supply passage, and a restricted portion proximate the branching portion. A motorcycle including a vehicle body frame is also described, where the water-cooled V-type engine is operatively attached to the vehicle body frame.

20 Claims, 7 Drawing Sheets

(56) References Cited

U.S. PATENT DOCUMENTS

| | | | | |
|---|---|---|---|---|
| 7,673,594 | B2 * | 3/2010 | Hirayama et al. | 123/41.44 |
| 7,921,829 | B2 * | 4/2011 | Hayashi | 123/568.12 |
| 2002/0023596 | A1 * | 2/2002 | Hirano et al. | 123/41.1 |
| 2002/0062795 | A1 * | 5/2002 | Inoue et al. | 123/41.1 |
| 2002/0096131 | A1 * | 7/2002 | Kuji | 123/41.1 |
| 2002/0124815 | A1 * | 9/2002 | Ishiguro et al. | 123/41.82 R |
| 2005/0183676 | A1 * | 8/2005 | Takano | 123/41.1 |
| 2005/0183686 | A1 * | 8/2005 | Fujii et al. | 123/90.58 |
| 2010/0170456 | A1 * | 7/2010 | Watanabe et al. | 123/41.74 |

* cited by examiner

WATER-COOLED V-TYPE ENGINE, AND MOTORCYCLE INCLUDING SAME

CROSS-REFERENCE TO RELATED APPLICATIONS

The present invention claims priority under 35 USC 119 based on Japanese patent application No. 2011-077676, filed on Mar. 31, 2011. The entire subject matter of this priority document, including specification claims and drawings thereof, is incorporated by reference herein.

BACKGROUND OF THE INVENTION

1. Field of the Invention

The present invention relates to cooling of the two cylinders of a water-cooled V-type engine, to a water-cooled V-type engine, and to a motorcycle including the V-type engine.

2. Background Art

In a conventionally known water-cooled V-type engine, a water pump is provided on the lower rear side of the engine (see Patent Document 1, for example). Further, in another conventionally known water-cooled V-type engine, a water pump is provided at the upper portion of a crankcase (see Patent Document 2, for example).

[Patent Document 1] Japanese Patent Laid-Open No. 2003-90264

[Patent Document 2] Japanese Patent Laid-Open No. 2000-87758

However, in the water-cooled V-type engine described in Patent Document 1 mentioned above, the water pump is located distantly from cylinder blocks and cylinder heads to be cooled, so that a coolant hose is very long, causing a possibility of increase in manufacturing cost. Further, in the water-cooled V-type engine described in Patent Document 2 mentioned above, a coolant hose can be made shorter than that of the water-cooled V-type engine described in Patent Document 1, but it is desired to further shorten the coolant hose.

SUMMARY OF THE INVENTION

The present invention has been made in view of the above circumstance, and it is accordingly an object of the present invention to provide a water-cooled V-type engine which can shorten a coolant hose.

Means for Solving the Problem

In accordance with a first aspect of the invention, there is provided a water-cooled V-type engine including first and second cylinders arranged so as to form a V-shape; water jackets formed in cylinder blocks and cylinder heads of the first and second cylinders; and a water pump for feeding a coolant from a radiator to the water jackets of the first and second cylinders, wherein the water pump is provided in the vicinity of the first cylinder; and the engine further includes a first coolant passage for supplying the coolant discharged from the water pump to the water jacket of the cylinder head of the first cylinder, and a second coolant passage which is branched from the first coolant passage, for supplying the coolant to the water jacket of the cylinder head of the second cylinder.

In accordance with a second aspect of the invention, in addition to the first aspect, the water-cooled V-type engine further includes a first discharge opening for discharging the coolant that has first cooled the cylinder head of the first cylinder and has next cooled the cylinder block of the first cylinder; a second discharge opening for discharging the coolant that has first cooled the cylinder head of the second cylinder and has next cooled the cylinder block of the second cylinder; and a coolant return passage for supplying the coolant discharged from the first discharge opening and the second discharge opening to the radiator.

In accordance with a third aspect of the invention, in addition to the first aspect, the water pump is mounted on the cylinder head of the first cylinder and driven by a camshaft.

In accordance with a fourth aspect of the invention, in addition to the first aspect, a restricted portion is provided in the vicinity of a branching portion where the second coolant passage is branched from the first coolant passage.

In accordance with a fifth aspect of the invention in addition to the fourth aspect, the branching portion is formed integrally with a pump body of the water pump.

In accordance with a sixth aspect of the invention in addition to the first aspect, at least a part of a bolt hole for a bolt for mounting the water pump is in communication with an inside space of the water pump, so that the bolt hole serves also as an air bleed hole.

In accordance with a seventh aspect of the invention in addition to the first aspect, an angle sensor for camshafts is mounted on the same surface as the mounting surface of the first cylinder for mounting the water pump.

In accordance with an eighth aspect of the invention in addition to the first aspect, the water-cooled V-type engine further includes a coolant routing duct connected to the upper portion of the radiator for connecting the water outlet of the radiator and the water pump; a connection pipe communicating with the coolant routing duct; and a pressure valve and an air bleeding mechanism both provided at the upper end of the connection pipe.

In accordance with a ninth aspect of the invention, in addition to the eighth aspect, the radiator includes a radiator core and right and left tank portions respectively provided on the right and left sides of the radiator core; the coolant routing duct is connected to the upper portion of one of the right and left tank portions; and a coolant discharge hose for supplying the coolant that has cooled the engine to the radiator is connected to the lower portion of the one of the right and left tank portions.

In accordance with a tenth aspect of the invention, in addition to the eighth aspect, the radiator is located on the front side of the water-cooled V-type engine; the first cylinder is a forward-tilted cylinder such that the cylinder head is located at a front upper portion of the water-cooled V-type engine; and the water outlet of the radiator and the water pump are arranged in tandem as viewed in side elevation.

Effect of the Invention

According to the first aspect of the invention, the water pump is provided in the vicinity of the first cylinder, and the engine includes the first coolant passage for supplying the coolant discharged from the water pump to the water jacket of the cylinder head of the first cylinder and the second coolant passage which is branched from the first coolant passage, for supplying the coolant to the water jacket of the cylinder head of the second cylinder. Accordingly, a coolant hose for feeding the coolant from the radiator to the cylinders can be shortened. Further, the coolant is first supplied to the cylinder heads, which operate at higher temperatures, so that the engine can be efficiently cooled.

According to the second aspect of the invention, the engine includes the first discharge opening for discharging the coolant that has first cooled the cylinder head of the first cylinder and has next cooled the cylinder block of the first cylinder, the second discharge opening for discharging the coolant that has first cooled the cylinder head of the second cylinder and has next cooled the cylinder block of the second cylinder, and the third coolant passage for supplying the coolant discharged from the first discharge opening and the second discharge opening to the radiator. Accordingly, a coolant hose for feeding the coolant from the cylinders to the radiator can be shortened.

According to the third aspect of the invention, the water pump is mounted on the cylinder head of the first cylinder and driven by the camshaft. Accordingly, the water pump is located at substantially the same level as that of the cylinder blocks and the cylinder heads. Accordingly, a vertical displacement of the coolant can be minimized, to facilitate coolant flow.

According to the fourth aspect of the invention, the restricted portion is provided in the vicinity of the branching portion where the second coolant passage is branched from the first coolant passage. Accordingly, the flow rate of the coolant in the first coolant passage can be controlled to be equal to the flow rate of the coolant in the second coolant passage.

According to the fifth aspect of the invention, the branching portion is formed integrally with the pump body of the water pump. Accordingly, the number of parts can be reduced and manufacturing cost can therefore be reduced.

According to the sixth aspect of the invention, at least a part of the bolt hole for the bolt for mounting the water pump is in communication with the inside space of the water pump, so that the bolt hole serves also as an air bleed hole. Accordingly, a separate, dedicated air bleed is not required, and manufacturing cost can therefore be reduced.

According to the seventh aspect of the invention, the angle sensor for the camshafts is mounted on the same surface as the mounting surface of the first cylinder for mounting the water pump. Accordingly, a dead space formed by mounting the water pump can be effectively used.

According to the eighth aspect of the invention, the water-cooled V-type engine includes the coolant routing duct connected to the upper portion of the radiator for connecting the water outlet of the radiator and the water pump, the connection pipe communicating with the coolant routing duct, and the pressure valve and the air bleeding mechanism both provided at the upper end of the connection pipe. Accordingly, the pressure valve and the air bleeding mechanism can be located near the upper portion of the radiator and the water pump. As a result, a pressure reduced by the water pump is applied to the pressure valve, so that the pressure valve can be reduced in size and weight. Further, since the air bleeding mechanism can be located near the upper portion of the radiator, the connection pipe can be shortened to be reduced in weight.

According to the ninth aspect of the invention, the radiator includes the radiator core and the right and left tank portions respectively provided on the right and left sides of the radiator core, wherein the coolant routing duct is connected to the upper portion of one of the right and left tank portions, and the coolant discharge hose for supplying the coolant that has cooled the engine to the radiator is connected to the lower portion of the one of the right and left tank portions. Accordingly, the coolant hoses are located on one side of the vehicle body, so that the workability in mounting the hoses to the radiator can be improved.

According to the tenth aspect of the invention, the radiator is located on the front side of the engine, and the first cylinder is a forward-tilted cylinder such that the cylinder head is located at a front upper portion of the water-cooled V-type engine. Further, the water outlet of the radiator and the water pump are arranged in tandem as viewed in side elevation. Accordingly, the coolant routing duct can be shortened.

For a more complete understanding of the present invention, the reader is referred to the following detailed description section, which should be read in conjunction with the accompanying drawings. Throughout the following detailed description and in the drawings, like numbers refer to like parts.

MODE FOR CARRYING OUT THE INVENTION

Figure 1:
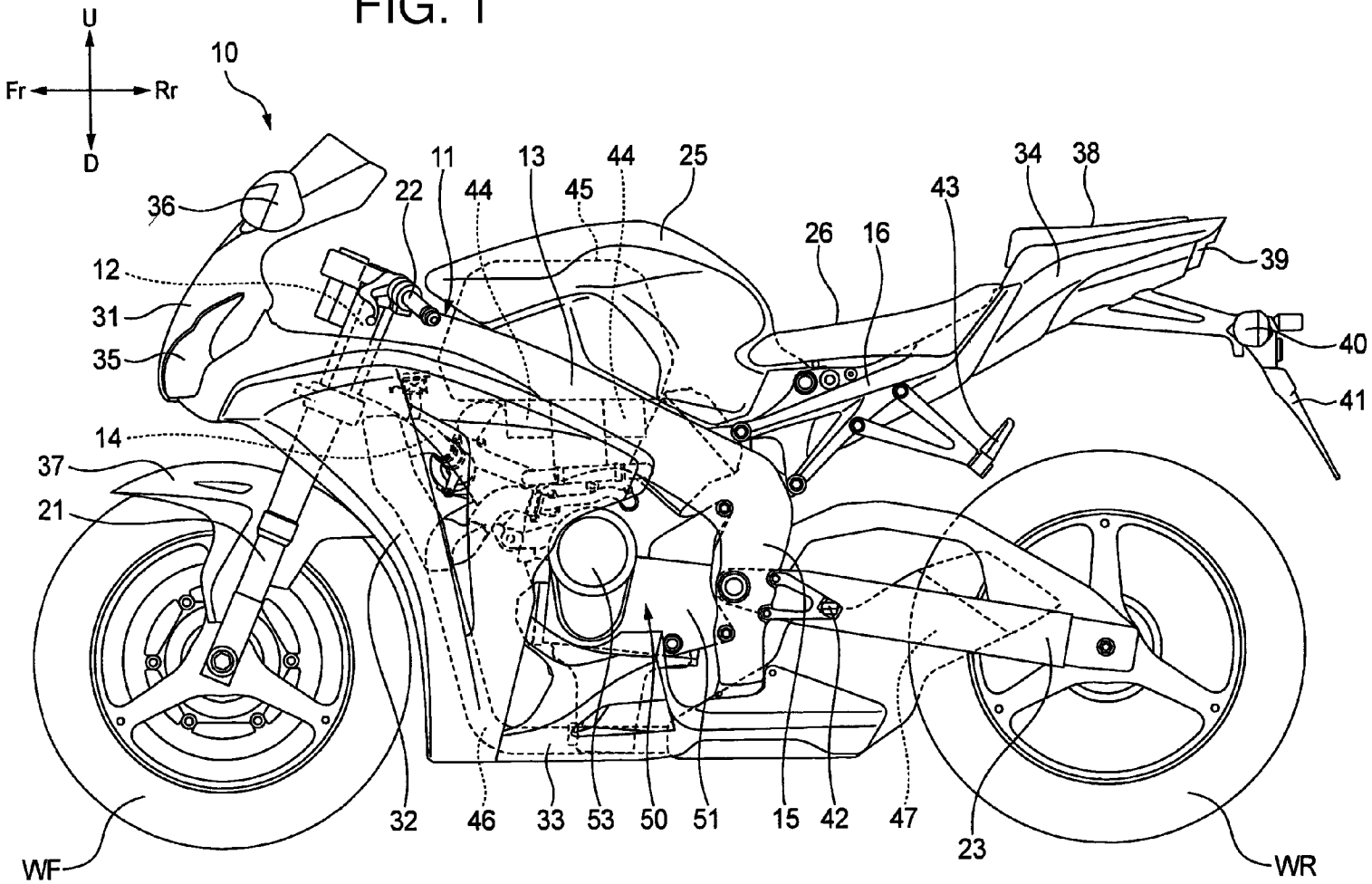
FIG. 1 is a left side view of a motorcycle including a preferred embodiment of the water-cooled V-type engine according to the present invention.

A preferred embodiment of the water-cooled V-type engine according to the present invention will now be described in detail with reference to the drawings. The orientation of each drawing is the same as that of the reference symbols included therein. In the following description, the terms in relation to directions, such as front, rear, right, left, upper, and lower are the same as those viewed a from a vantage point of an operator riding on the vehicle and facing forward. Further, in the drawings, the arrow Fr denotes the front side of the vehicle, the arrow Rr denotes the rear side of the vehicle, the arrow L denotes the left side of the vehicle, the arrow R denotes the right side of the vehicle, the arrow U denotes the upper side of the vehicle, and the arrow D denotes the lower side of the vehicle.

In FIG. 1, reference numeral 10 generally denotes a motorcycle in this preferred embodiment. The motorcycle 10 has a vehicle body frame 11. The vehicle body frame 11 is composed of a head pipe 12 forming a front end member, a pair of right and left main frames 13 extending rearward from the head pipe 12 so as to be inclined downward, a pair of right and left engine hangers 14 extending downward from the lower surfaces of the front portions of the right and left main frames 13, a pair of right and left pivot plates 15 connected to the rear ends of the right and left main frames 13 and extending downward, and a pair of right and left seat frames 16 connected to the upper portions of the right and left pivot plates 15 and extending rearward so as to be inclined upward. An engine 50 is mounted to the engine hangers 14 and the pivot plates 15.

The motorcycle 10 further includes a front fork 21 steerably supported to the head pipe 12, a front wheel WF rotatably supported to the lower ends of the front fork 21, a steering handle 22 mounted to the upper end of the front fork 21, a swing arm 23 pivotably supported to the pivot plates 15, a rear wheel WR rotatably supported to the rear ends of the swing arm 23, a fuel tank 25 provided above the engine 50 so as to be interposed between the right and left main frames 13, and an operator seat 26 mounted on the right and left seat frames 16.

The motorcycle 10 further includes a front cowl 31, front side cowl 32, under cowl 33, rear cowl 34, headlight 35, rear-view mirror 36, front fender 37, passenger seat 38, tail-light 39, rear turn signal 40, rear fender 41, main step 42, pillion step 43, throttle body 44, air cleaner 45, exhaust pipe 46, and muffler 47.

Figure 2:
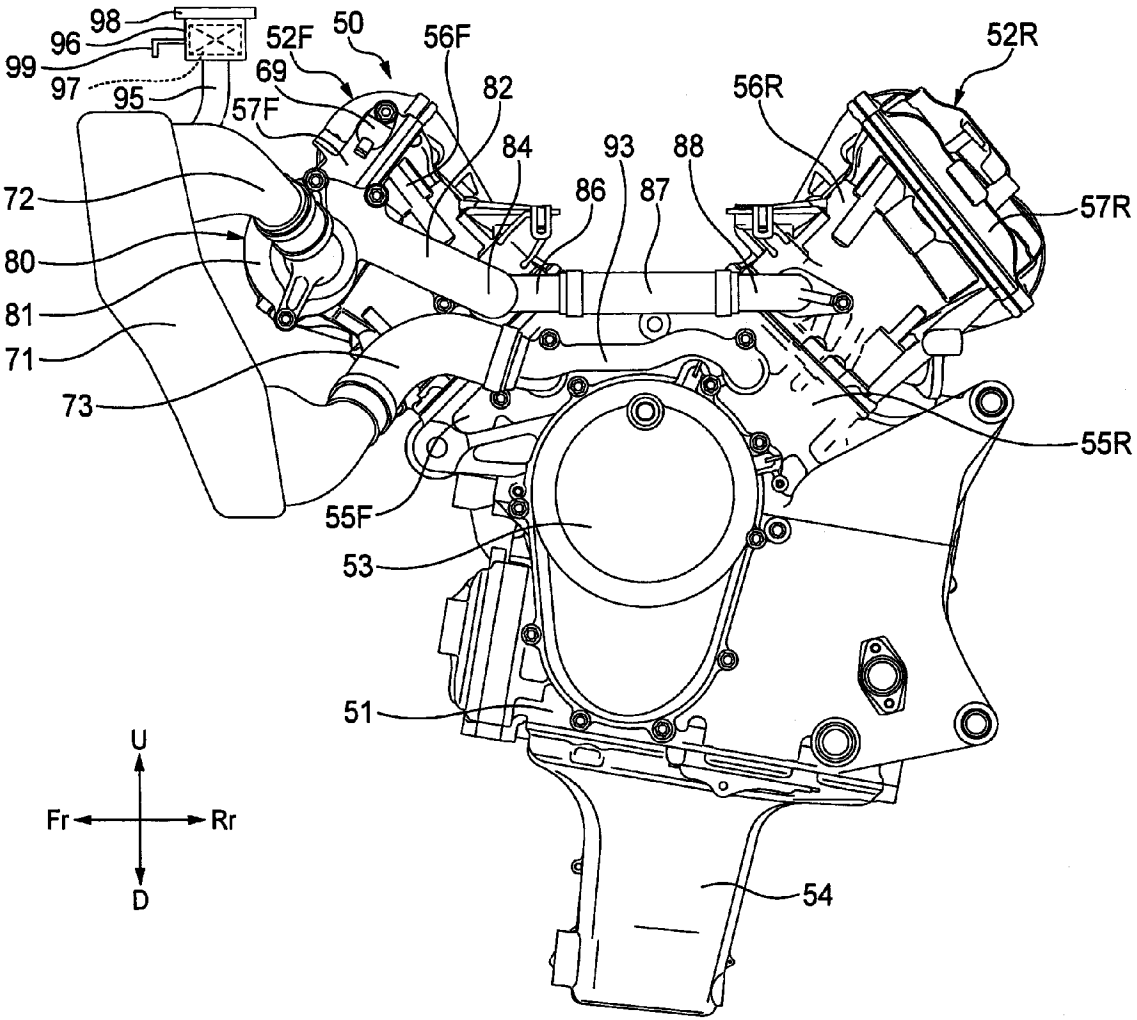
FIG. 2 is a left side view of the engine shown in FIG. 1.
Figure 3:
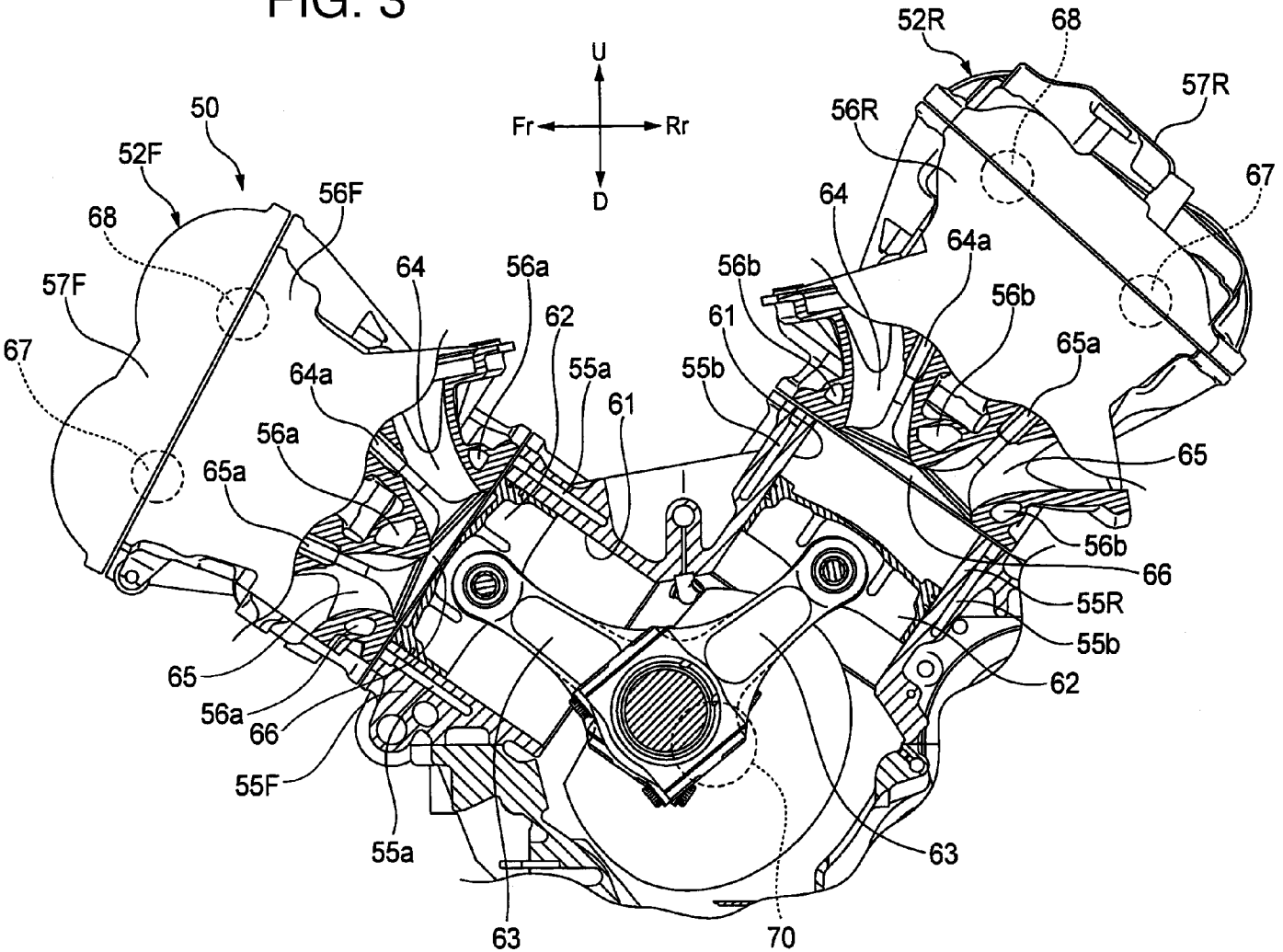
FIG. 3 is an enlarged vertical sectional view of the engine shown in FIG. 2.

As shown in FIGS. 2 and 3, the engine 50 is a water-cooled V-type four-cylinder engine, and it includes a crankcase 51, front and rear cylinders 52F and 52R provided at respective upper front and upper rear portions of the crankcase 51 so as to form a V-shape, a generator cover 53 mounted on the left side surface of the crankcase 51, a clutch cover (not shown) mounted on the right side surface of the crankcase 51, and an oil pan 54 mounted on the lower surface of the crankcase 51. Further, a crankshaft 70 is rotatably supported in the crankcase 51, and oriented so as to extend in the lateral direction of the vehicle.

The front cylinder 52F includes a cylinder block 55F formed integrally with the crankcase 51 at a front upper portion thereof, a cylinder head 56F mounted on the upper end of the cylinder block 55F, and a cylinder head cover 57F mounted on the upper end of the cylinder head 56F. Similarly, the rear cylinder 52R includes a cylinder block 55R formed integrally with the crankcase 51 at a rear upper portion thereof, a cylinder head 56R mounted on the upper end of the cylinder block 55R, and a cylinder head cover 57R mounted on the upper end of the cylinder head 56R.

As shown in FIG. 3, the each of the cylinder blocks 55F and 55R has a respective cylinder bore 61 formed therein, and a piston 62 is slidably fitted in each of the cylinder bores 61. The pistons 62 are connected through connecting rods 63 to the crankshaft 70, respectively. The crankshaft 70 is rotationally driven by the reciprocating motion of the pistons 62.

Each of the cylinder heads 56F and 56R is formed with an intake port 64 and an exhaust port 65, wherein an intake valve 64*a* is provided in the intake port 64 and an exhaust valve 65*a* is provided in the exhaust port 65. Further, each of the cylinder heads 56F and 56R is provided with a pair of camshafts 67 and 68 for respectively operating the intake valve 64*a* and the exhaust valve 65*a*. The camshafts 67 and 68 are rotatably supported on each of the cylinder heads 56F and 56R. Further, the lower surface of each of the cylinder heads 56F and 56R is formed with a combustion chamber 66 therein, where a lower part of the combustion chamber is temporarily formed by an upper surface of the corresponding piston 62, when it is at an upper range of travel.

As shown in FIG. 3, the cylinder blocks 55F and 55R are respectively formed with block water jackets 55*a* and 55*b* therein for conducting a flow of coolant therethrough. Similarly, the cylinder heads 56F and 56R are respectively formed with cylinder head water jackets 56*a* and 56*b* therein for conducting a flow of coolant therethrough. Further, the block water jacket 55*a* (55*b*) of the cylinder block 55F (55R) is in communication with the corresponding cylinder head water jacket 56*a* (56*b*) of the cylinder head 56F (56R).

Figure 4:
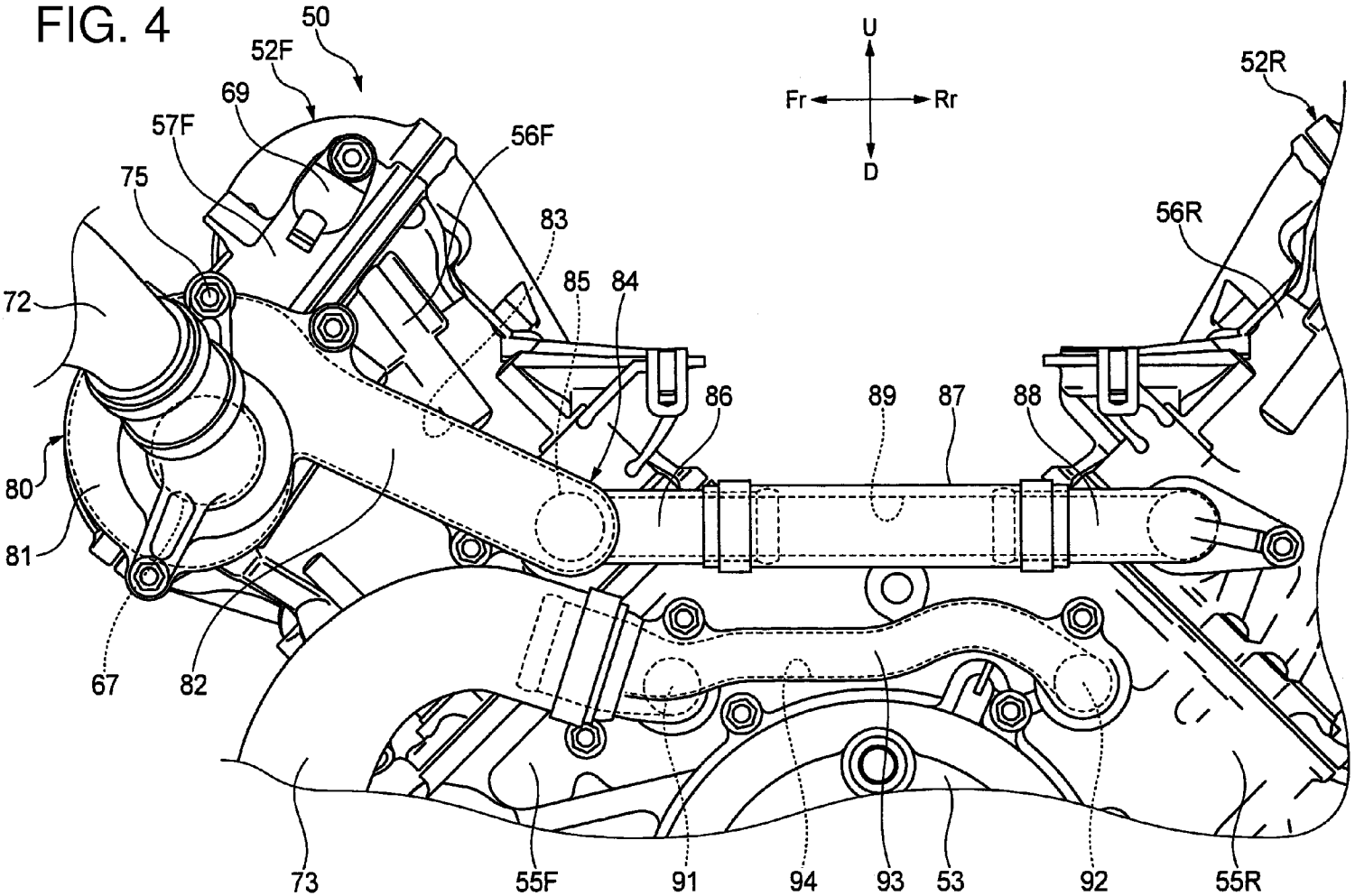
FIG. 4 is an enlarged left side view of coolant passages and their periphery shown in FIG. 2.

As shown in FIGS. 2 and 4, a radiator 71 for cooling the coolant is provided on the front side of the front cylinder 52F, and a water pump 80 is mounted on the left side surface of the cylinder head 56F of the front cylinder 52F. The water pump 80 is provided for feeding the coolant from the radiator 71 to the water jackets 55*a*, 55*b*, 56*a*, and 56*b* of the cylinders 52F and 52R.

The water pump 80 is connected to the left end of the lower camshaft 67 of the front cylinder head 56 and is driven by this camshaft 67. A water inlet of the water pump 80 and a water outlet of the radiator 71 are connected by a coolant routing duct 72.

Figure 5:
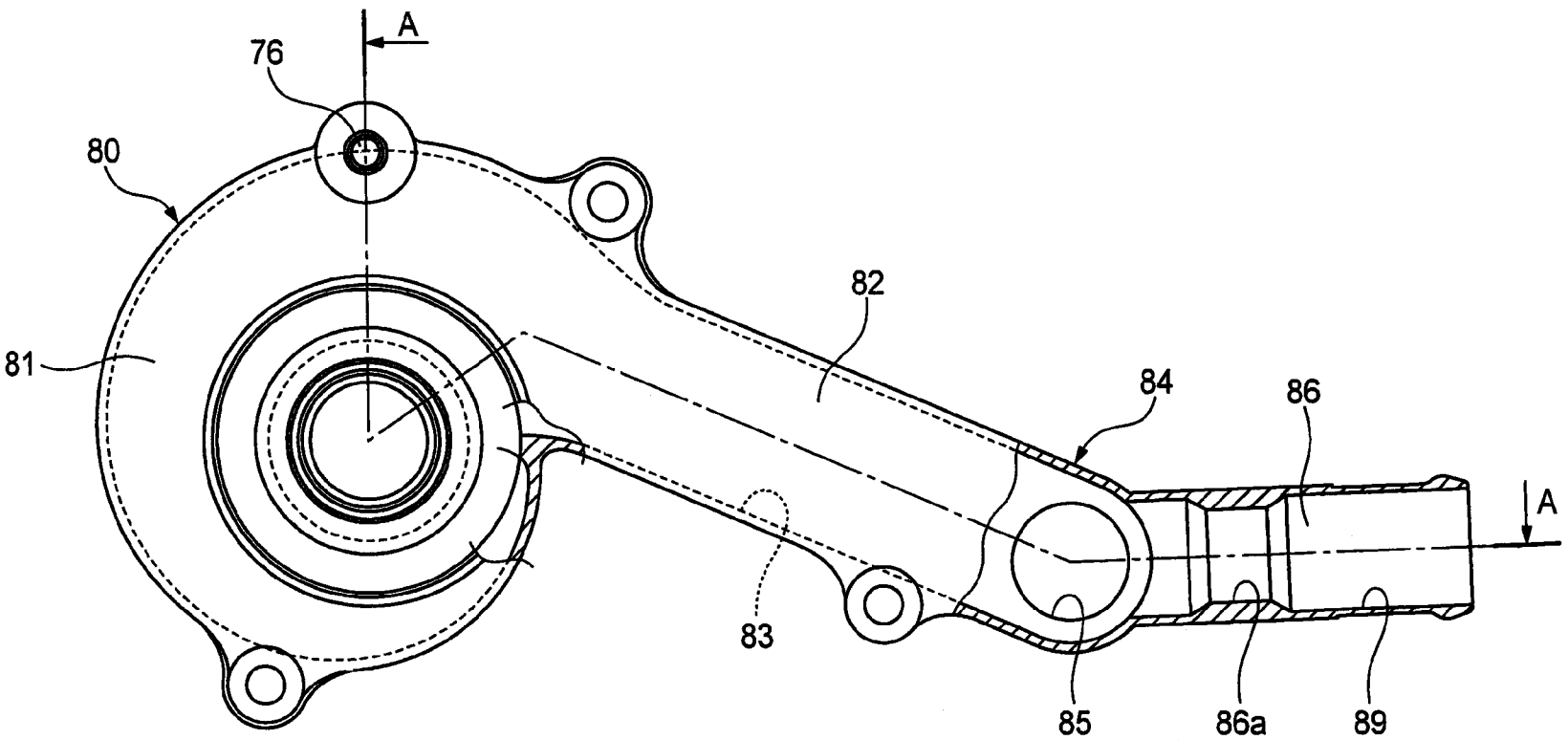
FIG. 5 is a side view of a water pump shown in FIG. 4.
Figure 6:
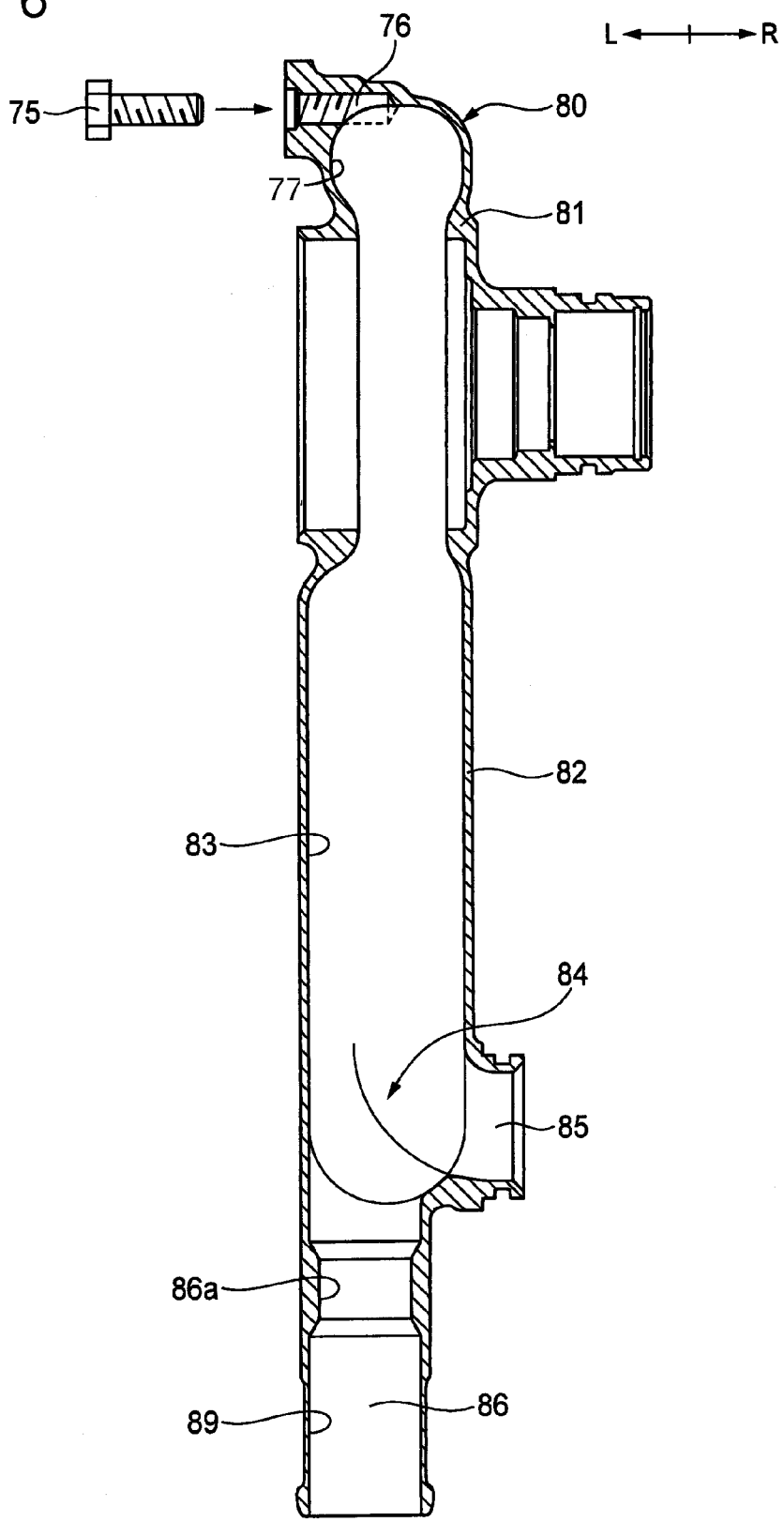
FIG. 6 is a cross section taken along the line A-A in FIG. 5.

As shown in FIGS. 4 to 6, the water pump 80 includes a pump body 81 and a fluid conduit 82, which extends rearwardly from the pump body 81 so as to be inclined downwardly. The fluid conduit 82 has a first coolant supply passage 83 formed therein for supplying the coolant discharged from the water pump 80 to the water jacket 56*a* of the front cylinder head 56F.

The upper end portion of the pump body 81 is formed with a bolt hole 76 for a bolt 75 for mounting the water pump 80. A part of the bolt hole 76 is in communication with an inside space 77 (FIG. 6) of the water pump 80. Accordingly, the bolt hole 76 serves also as an air bleed hole for a coolant passage 83.

The rear end portion of the fluid conduit 82 is formed with a branching portion 84 for branching the coolant in the first coolant supply passage 83. The branching portion 84 includes a first branch pipe 85 which extends laterally inside of the engine, for supplying coolant to the water jacket 56*a* of the front cylinder head 56F. The branching portion 84 also includes a second branch pipe 86 which extends toward the rear of the vehicle, for supplying coolant to the water jacket 56*b* of the rear cylinder head 56R. The branching portion 84 and the fluid conduit 82 are both formed integrally with the pump body 81 of the water pump 80.

A coolant-receiving pipe 88 is mounted on the left side surface of the rear cylinder head 56R so as to extend frontward of the vehicle. The coolant-receiving pipe 88 is connected through a coolant supply hose 87 to the second branch pipe 86. The coolant-receiving pipe 88 functions to supply the coolant fed from the second branch pipe 86 to the water jacket 56*b* of the rear cylinder head 56R. In this preferred embodiment, the second branch pipe 86, the coolant supply hose 87, and the inner surface of the coolant-receiving pipe 88 form a second coolant supply passage 89.

The second branch pipe 86 is formed with a restricted portion 86*a* over the entire circumference thereof so that the cross section of the restricted portion 86*a* is substantially trapezoidal. The restricted portion 86*a* functions to reduce the inner diameter of the second coolant supply passage 89 at a portion in the vicinity of the first branch pipe 85.

Referring again to FIG. 4, it will be seen that the left side surface of the front cylinder block 55F is formed with a first discharge opening 91 for discharging the coolant that has first cooled the water jacket 56*a* of the front cylinder head 56F and has next cooled the water jacket 55*a* of the front cylinder block 55F. Similarly, the left side surface of the rear cylinder block 55R is formed with a second discharge opening 92 for discharging the coolant that has first cooled the water jacket 56*b* of the rear cylinder head 56R and has next cooled the water jacket 55*b* of the rear cylinder block 55R.

A coolant discharge pipe 93 is mounted on the left side surfaces of the cylinder blocks 55F and 55R so as to extend in the longitudinal direction of the vehicle. The coolant discharge pipe 93 has a third coolant passage 94 for receiving the coolant discharged from the first and second discharge openings 91, 92 and for supplying them to the radiator 71. The front end portion of the coolant discharge pipe 93 is connected through a coolant discharge hose 73 to a water inlet of the radiator 71. Accordingly, the coolant that has cooled the engine 50 is introduced through the coolant discharge pipe 93 and the coolant discharge hose 73 to the radiator 71.

In the engine 50 mentioned above, the coolant discharged from the water pump 80 flows in the following order: the first coolant supply passage 83 of the fluid conduit 82; the first branch pipe 85; the water jacket 56*a* of the front cylinder head 56F; the water jacket 55*a* of the front cylinder block 55F; the first discharge opening 91; and the third coolant passage 94 of the coolant discharge pipe 93.

The coolant discharged from the water pump 80 also flows in the following order: the first coolant supply passage 83 of the fluid conduit 82; the second coolant supply passage 89 of the second branch pipe 86, the coolant supply hose 87, and the coolant-receiving pipe 88; the water jacket 56*b* of the rear cylinder head 56R; the water jacket 55*b* of the rear cylinder block 55R; the second discharge opening 92; and the third coolant passage 94 of the coolant discharge pipe 93.

The coolant from the coolant discharge pipe 93 flows in the following order: the coolant discharge hose 73; the radiator 71; and the coolant routing duct 72. The coolant is finally returned to the water pump 80.

As shown in FIG. 4, in the preferred embodiment, an angle sensor 69 for the camshafts 67 and 68 is mounted on the left side surface of the cylinder head cover 57F of the front cylinder 52F at a position on the upper rear side of the water pump 80.

Figure 7:
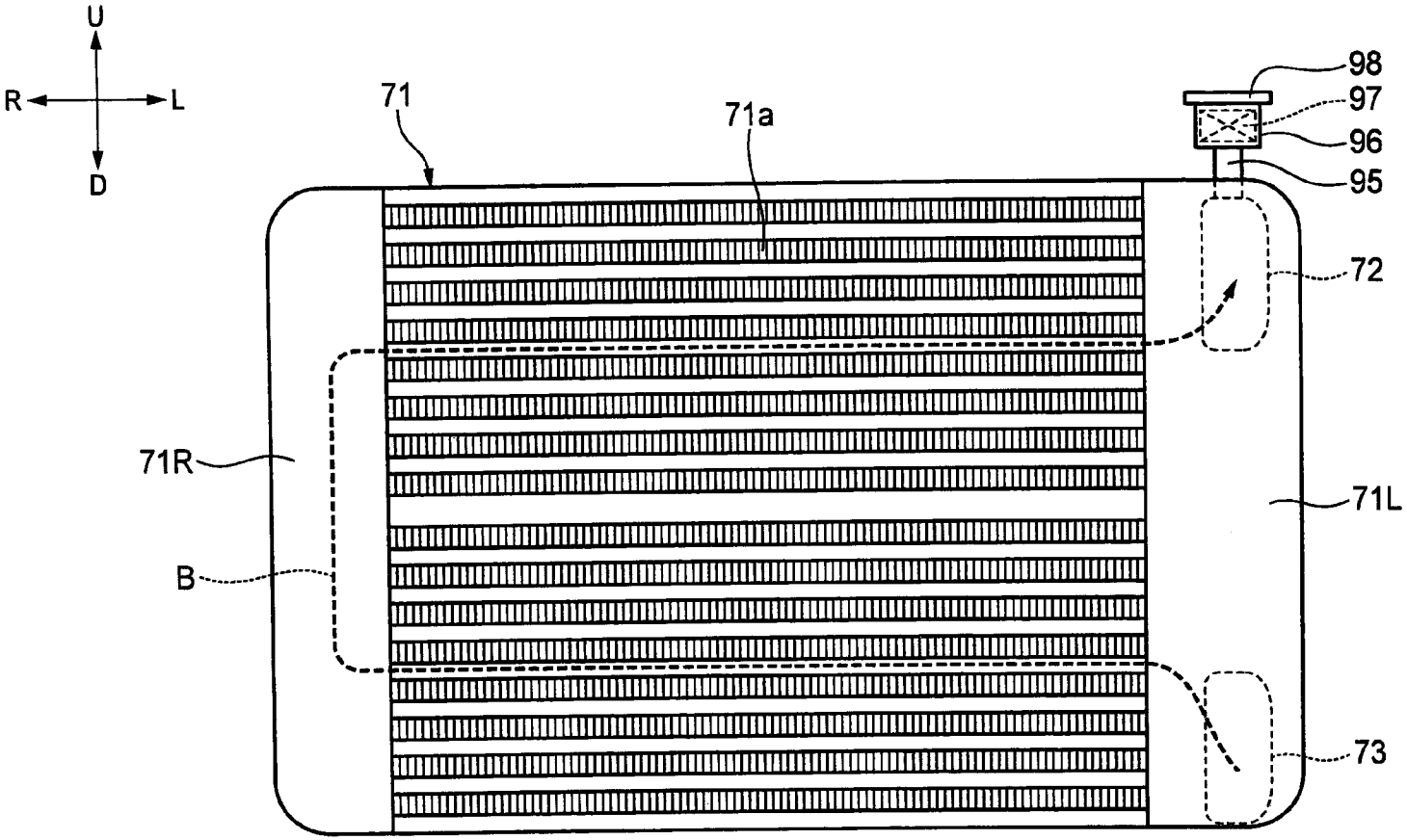
FIG. 7 is a front view of a radiator shown in FIG. 2.

In this preferred embodiment, as shown in FIGS. 2 and 7, the radiator 71 includes a radiator core 71*a* and right and left tank portions 71R and 71L respectively provided on the right and left sides of the radiator core 71*a*. The coolant routing duct 72 is connected to the upper portion of the left tank portion 71L, and the coolant discharge hose 73 is connected to the lower portion of the left tank portion 71L. The arrow shown by reference symbol B in FIG. 7 represents the flow of the coolant in the radiator 71.

The coolant routing duct 72 is provided with a connection pipe 95 communicating therewith, a filler neck 96 provided at the upper end of the connection pipe 95, a pressure valve 97 provided in the filler neck 96, and a filler cap (air bleeding mechanism) 98 for closing the upper end opening of the filler neck 96. In FIG. 2, reference numeral 99 denotes a pipe connected to a reservoir tank.

As shown in FIG. 2, the radiator 71 is located on the front side of the engine 50, and the front cylinder 52F is a forward-tilted cylinder such that the cylinder head 56F is located at a front upper portion of the engine 50. Further, the water outlet of the radiator 71 and the water pump 80 are arranged in tandem as viewed in side elevation.

According to the water-cooled V-type engine 50 of this preferred embodiment mentioned above, the water pump 80 is provided on the front cylinder 52F, and the engine 50 includes the first coolant supply passage 83 for supplying the coolant discharged from the water pump 80 to the water jacket 56*a* of the cylinder head 56F of the front cylinder 52F and the second coolant supply passage 89 which is branched from the first coolant supply passage 83, for supplying the coolant to the water jacket 56*b* of the cylinder head 56R of the rear cylinder 52R. Accordingly, the coolant hoses 72 and 87 for feeding the coolant from the radiator 71 to the cylinders 52F and 52R can be shortened. Further, the coolant is first supplied to the cylinder heads 56F and 56R which become higher temperatures, so that the engine 50 can be efficiently cooled.

According to the water-cooled V-type engine 50 of this preferred embodiment, the engine 50 includes the first discharge opening 91 for discharging the coolant that has first cooled the cylinder head 56F of the front cylinder 52F and has next cooled the cylinder block 55F of the front cylinder 52F, the second discharge opening 92 for discharging the coolant that has first cooled the cylinder head 56R of the rear cylinder 52R and has next cooled the cylinder block 55R of the rear cylinder 52R, and the third coolant passage 94 for supplying the coolant discharged from the first discharge opening 91 and the second discharge opening 92 to the radiator 71. Accordingly, the coolant hose 73 for feeding the coolant from the cylinders 52F and 52R to the radiator 71 can be shortened.

According to the water-cooled V-type engine 50 of this preferred embodiment, the water pump 80 is mounted on the cylinder head 56F of the front cylinder 52F and driven by the camshaft 67. Accordingly, the water pump 80 is located at substantially the same level as that of the cylinder blocks 55F and 55R and the cylinder heads 56F and 56R. Consequently, a vertical displacement of the coolant can be reduced to thereby facilitate the flow of the coolant.

According to the water-cooled V-type engine 50 of this preferred embodiment, the second branch pipe 86 is formed with the restricted portion 86*a* in the vicinity of the branching portion 84 where the second coolant supply passage 89 is branched from the first coolant supply passage 83. Accordingly, the flow rate of the coolant in the first coolant supply passage 83 can be controlled to be equal to the flow rate of the coolant in the second coolant supply passage 89.

According to the water-cooled V-type engine 50 of this preferred embodiment, the branching portion 84 is formed integrally with the pump body 81 of the water pump 80. Accordingly, the number of parts can be reduced and a manufacturing cost can therefore be reduced.

According to the water-cooled V-type engine 50 of this preferred embodiment, a part of the bolt hole 76 for the bolt 75 for mounting the water pump 80 is in communication with the inside space 77 of the water pump 80, so that the bolt hole 76 serves also as an air bleed hole. Accordingly, any dedicated hole as an air bleed hole is not required and a manufacturing cost can therefore be reduced.

According to the water-cooled V-type engine 50 of this preferred embodiment, the angle sensor 69 for the camshafts 67 and 68 is mounted on the left side surface of the cylinder head cover 57F of the front cylinder 52F which surface is the same surface as the mounting surface for the water pump 80. Accordingly, a dead space formed by mounting the water pump 80 can be effectively used.

According to the water-cooled V-type engine 50 of this preferred embodiment, the engine 50 includes the coolant routing duct 72 connected to the upper portion of the left tank portion 71L of the radiator 71 for connecting the water outlet of the radiator 71 and the water pump 80, the connection pipe 95 communicating with the coolant routing duct 72, and the pressure valve 97 and the filler cap 98 both provided at the upper end of the connection pipe 95. Accordingly, the pressure valve 97 and the filler cap 98 can be located near the upper portion of the radiator 71 and the water pump 80. As a result, a pressure reduced by the water pump 80 is applied to the pressure valve 97, so that the pressure valve 97 can be reduced in size and weight. Further, since the filler cap 98 can be located near the upper portion of the radiator 71, the connection pipe 95 can be shortened to be reduced in weight.

According to the water-cooled V-type engine 50 of this preferred embodiment, the radiator 71 includes the radiator core 71*a* and the right and left tank portions 71R and 71L respectively provided on the right and left sides of the radiator core 71*a*, wherein the coolant routing duct 72 is connected to the upper portion of the left tank portion 71L, and the coolant discharge hose 73 is connected to the lower portion of the left tank portion 71L. Accordingly, the coolant hoses 72 and 73 are located on one side of the vehicle body, so that the workability in mounting the hoses to the radiator 71 can be improved.

According to the water-cooled V-type engine 50 of this preferred embodiment, the radiator 71 is located on the front side of the engine 50, and the front cylinder 52F is a forward-tilted cylinder such that the cylinder head 56F is located at a front upper portion of the engine 50. Further, the water outlet of the radiator 71 and the water pump 80 are arranged in tandem as viewed in side elevation. Accordingly, the coolant routing duct 72 can be shortened.

The present invention is not limited to the above preferred embodiment, but various modifications may be made without departing from the scope of the present invention.

We claim:

1. A water-cooled V-type engine, comprising:

first and second cylinders arranged so as to form a V-shape, said first cylinder comprising a first cylinder block having a first block water jacket formed therein and a first cylinder head attached to said first cylinder block and having a first cylinder head water jacket formed therein in fluid communication with the first block water jacket;

said second cylinder comprising a second cylinder block having a second block water jacket formed therein and a second cylinder head attached to said second cylinder block and having a second cylinder head water jacket formed therein in fluid communication with the second block water jacket;

a water pump for transferring coolant from a radiator to the water jackets of said first and second cylinders, said water pump situated proximate said first cylinder;

wherein said engine further includes a first coolant supply passage for supplying coolant from said water pump to the first cylinder head water jacket, and a second coolant supply passage which is branched from said first coolant supply passage for supplying coolant to said second cylinder head water jacket;

a first discharge opening formed in the first cylinder block for discharging coolant that has first cooled said first cylinder head and has then cooled said first cylinder block;

a second discharge opening formed in the second cylinder block for discharging coolant that has first cooled said second cylinder head and has then cooled said second cylinder block; and a discharge pipe extending between the first and second cylinder blocks, said discharge pipe having a coolant return passage formed therein for routing coolant from said first and second discharge openings toward said radiator.

2. The water-cooled V-type engine according to claim 1, wherein said water pump is mounted on said first cylinder head and driven by a camshaft.

3. The water-cooled V-type engine according to of claim 1, further comprising a fluid conduit comprising a branching portion where said second coolant supply passage is branched from said first coolant supply passage, and a restricted portion proximate said branching portion.

4. The water-cooled V-type engine according to claim 3, wherein said fluid conduit is formed integrally with a pump body of said water pump.

5. The water-cooled V-type engine according to claim 1, wherein said water pump has a plurality of bolt holes formed therein for receiving mounting bolts, and wherein one of said bolt holes is in fluid communication with an inside space of said water pump, so that said bolt hole also serves as an air bleed hole.

6. The water-cooled V-type engine according to claim 1, wherein said water pump is mounted on a mounting surface of said first cylinder, and wherein a cam angle sensor for sensing a rotary position of a camshaft is also mounted on the mounting surface of said first cylinder.

7. The water-cooled V-type engine according to claim 1, further comprising:

a coolant routing duct connected to an upper portion of said radiator for conveying coolant from said radiator toward said water pump;

a connection pipe communicating with said coolant routing duct; and a pressure valve and an air bleeding mechanism both provided at an upper end of said connection pipe.

8. The water-cooled V-type engine according to claim 7, wherein:

the radiator includes a radiator core and right and left tank portions respectively provided on right and left sides of said radiator core;

said coolant routing duct is connected to an upper portion of one of said right and left tank portions; and a coolant discharge hose for supplying coolant from said engine to said radiator is operatively connected to a lower portion of the same tank portion to which said coolant routing duct is connected.

9. The water-cooled V-type engine according to claim 7, wherein:

the radiator is located on the front side of said water-cooled V-type engine;

said first cylinder is a forward-tilted cylinder such that said cylinder head is located at a front upper portion of said water-cooled V-type engine; and water outlets of said radiator and said water pump are arranged in tandem as viewed in side elevation.

10. A motorcycle comprising a vehicle body frame and a V-type engine operatively attached to said vehicle body frame, said engine comprising:

first and second cylinders arranged so as to form a V-shape, said first cylinder comprising a first cylinder block having a first block water jacket formed therein and a first cylinder head attached to said first cylinder block and having a first cylinder head water jacket formed therein in fluid communication with the first block water jacket;

said second cylinder comprising a second cylinder block having a second block water jacket formed therein and a second cylinder head attached to said second cylinder block and having a second cylinder head water jacket formed therein in fluid communication with the second block water jacket;

a water pump for transferring coolant from a radiator to the water jackets of said first and second cylinders, said water pump situated proximate said first cylinder;

wherein said engine further includes a first coolant supply passage for supplying coolant from said water pump to the first cylinder head water jacket, and a second coolant supply passage which is branched from said first coolant supply passage for supplying coolant to said second cylinder head water jacket;

a first discharge opening formed in the first cylinder block for discharging coolant that has first cooled said first cylinder head and has then cooled said first cylinder block;

a second discharge opening formed in the second cylinder block for discharging coolant that has first cooled said second cylinder head and has then cooled said second cylinder block; and a discharge pipe extending between the first and second cylinder blocks, said discharge pipe having a coolant return passage formed therein for routing coolant from said first and second discharge openings toward said radiator.

11. The motorcycle according to claim 10, wherein said water pump is mounted on said first cylinder head and driven by a camshaft.

12. The motorcycle according to claim 10, further comprising a fluid conduit comprising a branching portion where said second coolant supply passage is branched from said first coolant supply passage, and a restricted portion proximate said branching portion.

13. The motorcycle according to claim 12, wherein said fluid conduit is formed integrally with a pump body of said water pump.

14. The motorcycle according to claim 10, wherein said water pump has a plurality of bolt holes formed therein for receiving mounting bolts, and wherein one of said bolt holes is in fluid communication with an inside space of said water pump, so that said bolt hole also serves as an air bleed hole.

15. The motorcycle according to claim 10, wherein said water pump is mounted on a mounting surface of said first cylinder, and wherein a cam angle sensor for sensing a rotary position of a camshaft is also mounted on the mounting surface of said first cylinder.

16. The motorcycle according to claim 10, further comprising:

a coolant routing duct connected to an upper portion of said radiator for conveying coolant from said radiator toward said water pump;

a connection pipe communicating with said coolant routing duct; and a pressure valve and an air bleeding mechanism both provided at an upper end of said connection pipe.

17. The motorcycle according to claim 16, wherein:

the radiator includes a radiator core and right and left tank portions respectively provided on right and left sides of said radiator core;

said coolant routing duct is connected to an upper portion of one of said right and left tank portions; and a coolant discharge hose for supplying coolant from said engine to said radiator is operatively connected to a lower portion of the same tank portion to which said coolant routing duct is connected.

18. The motorcycle according to claim 16, wherein:

the radiator is located on the front side of said water-cooled V-type engine;

said first cylinder is a forward-tilted cylinder such that said cylinder head is located at a front upper portion of said water-cooled V-type engine; and water outlets of said radiator and said water pump are arranged in tandem as viewed in side elevation.

19. A water-cooled V-type engine, comprising:

first and second cylinders arranged so as to form a V-shape, said first cylinder comprising a first cylinder block having a first block water jacket formed therein and a first cylinder head attached to said first cylinder block and having a first cylinder head water jacket formed therein in fluid communication with the first block water jacket;

said second cylinder comprising a second cylinder block having a second block water jacket formed therein and a second cylinder head attached to said second cylinder block and having a second cylinder head water jacket formed therein in fluid communication with the second block water jacket;

a water pump for transferring coolant from a radiator to the water jackets of said first and second cylinders, said water pump situated proximate said first cylinder;

wherein said engine further includes a first coolant supply passage for supplying coolant from said water pump to the first cylinder head water jacket, and a second coolant supply passage which is branched from said first coolant supply passage for supplying coolant to said second cylinder head water jacket;

a coolant routing duct connected to an upper portion of said radiator for conveying coolant from said radiator toward said water pump;

a connection pipe communicating with said coolant routing duct; and a pressure valve and an air bleeding mechanism both provided at an upper end of said connection pipe.

20. A motorcycle comprising a vehicle body frame and a V-type engine operatively attached to said vehicle body frame comprising:

first and second cylinders arranged so as to form a V-shape, said first cylinder comprising a first cylinder block having a first block water jacket formed therein and a first cylinder head attached to said first cylinder block and having a first cylinder head water jacket formed therein in fluid communication with the first block water jacket;

said second cylinder comprising a second cylinder block having a second block water jacket formed therein and a second cylinder head attached to said second cylinder block and having a second cylinder head water jacket formed therein in fluid communication with the second block water jacket;

a water pump for transferring coolant from a radiator to the water jackets of said first and second cylinders, said water pump situated proximate said first cylinder;

wherein said engine further includes a first coolant supply passage for supplying coolant from said water pump to the first cylinder head water jacket, and a second coolant supply passage which is branched from said first coolant supply passage for supplying coolant to said second cylinder head water jacket;

a coolant routing duct connected to an upper portion of said radiator for conveying coolant from said radiator toward said water pump;

a connection pipe communicating with said coolant routing duct; and a pressure valve and an air bleeding mechanism both provided at an upper end of said connection pipe.

* * * * *